US006634147B2

(12) United States Patent
Nützel

(10) Patent No.: US 6,634,147 B2
(45) Date of Patent: Oct. 21, 2003

(54) PROCESS FOR THE INSTALLATION AND TENSIONING OF A BRACE HAVING A FALSE BEARING, IN PARTICULAR A STAY CABLE FOR A CABLE-STAYED BRIDGE AND ANCHORING DEVICE WITH WHICH TO CARRY OUT THE PROCESS

(75) Inventor: Oswald Nützel, München (DE)

(73) Assignee: Walter Bau-Aktiengesellschaft, Aschheim (DE)

( * ) Notice: Subject to any disclaimer, the term of this patent is extended or adjusted under 35 U.S.C. 154(b) by 0 days.

(21) Appl. No.: 10/016,649

(22) Filed: Dec. 12, 2001

(65) Prior Publication Data

US 2002/0088105 A1 Jul. 11, 2002

(30) Foreign Application Priority Data

Dec. 13, 2000 (DE) ..... 100 62 227

(51) Int. Cl.[7] ..... E04C 5/08

(52) U.S. Cl. ..... 52/223.1; 52/223.13; 52/223.14; 264/228; 29/446; 29/452; 425/111; 24/122.6

(58) Field of Search ..... 52/223.1, 223.13, 52/223.14, 223.8, 223.11, 223.12; 264/228; 425/111; 24/122.6; 403/374.1, 367, 368; 29/446, 452

(56) References Cited

U.S. PATENT DOCUMENTS

| | | | | | |
|---|---|---|---|---|---|
| 4,343,122 | A | * | 8/1982 | Wlodkowski et al. | 52/223.13 |
| 4,612,680 | A | * | 9/1986 | Daiguji | 14/22 |
| 4,616,458 | A | * | 10/1986 | Davis et al. | 52/223.13 |
| 4,773,198 | A | * | 9/1988 | Reinhardt | 52/223.13 |
| 4,837,885 | A | * | 6/1989 | Yang | 14/21 |
| 4,848,052 | A | * | 7/1989 | Nutzel | 52/223.13 |
| 5,289,626 | A | * | 3/1994 | Mochida et al. | 29/452 |
| 5,701,707 | A | * | 12/1997 | Sorkin | 52/223.13 |
| 5,924,250 | A | * | 7/1999 | Jungwirth et al. | 52/223.9 |
| 6,318,038 | B1 | * | 11/2001 | Park | 52/223.13 |
| 6,324,709 | B1 | * | 12/2001 | Ikeda et al. | 5/185 |
| 6,354,596 | B1 | * | 3/2002 | Rodriguez | 277/317 |
| 6,381,912 | B1 | * | 5/2002 | Sorkin | 52/223.13 |

FOREIGN PATENT DOCUMENTS

| | | | |
|---|---|---|---|
| DE | 197 33 822 A1 | | 2/1999 |
| EP | 428304 | * | 5/1991 |
| JP | 5-5365 | * | 1/1993 |
| JP | 5-118139 | * | 5/1993 |

* cited by examiner

*Primary Examiner*—Jeanette Chapman
(74) *Attorney, Agent, or Firm*—Friedrich Kueffner

(57) ABSTRACT

In order to install or tension a brace (1) having a false bearing, for example a stay cable for a cable-stayed bridge, an external tensioning member or similar comprising a bundle of plastic-sheathed individual elements (2) made of steel, for example, wires, strands of wires or similar, the individual elements (2) are exposed in the area of the anchoring in order that they may be anchored at this point in holes (6) in an anchoring plate (7) which is supported by the building structure (9) by means of wedges (5). In order to ensure that when the strand is anchored the remaining plastic jacket (4) ends as close as possible to the anchoring plate (7), it is suggested that the plastic jacket be prevented from making any longitudinal movement during the extension of each individual element (2) which occurs during tensioning by a stop in the form of an annular shoulder (**6*d*) which surrounds the element (2**) in the anchoring area, and thereby compressed.

11 Claims, 3 Drawing Sheets

PROCESS FOR THE INSTALLATION AND TENSIONING OF A BRACE HAVING A FALSE BEARING, IN PARTICULAR A STAY CABLE FOR A CABLE-STAYED BRIDGE AND ANCHORING DEVICE WITH WHICH TO CARRY OUT THE PROCESS

FIELD OF THE INVENTION

The invention relates to a process for the installation and tensioning of a brace having a false bearing, for example a stay cable for a cable-stayed bridge, an external tensioning member or similar comprising a bundle of plastic-sheathed individual elements made of steel such as, for example, wires, strands of wires or similar, and anchoring devices suitable for carrying out this process.

BACKGROUND OF THE INVENTION

In many cases braces such as those used in the construction industry for anchoring building components, for example as stay cables for cable-stayed bridges, external tensioning members or similar bracing elements, consist of a bundle of individual elements such as steel wires or strands of wires which are positioned together in a tubular sheath in the free area of the brace, passed through the relevant building components and anchored at the end opposite the point of entry therein by means of anchoring devices. These anchoring devices generally consist of an anchoring plate with holes through which the individual elements are passed. The holes have initially a cylindrical and subsequently a conical area in which the individual elements are anchored by means of multiple ring wedges. The free area of the tubular sheath around the brace may be made of a plastic such as polyethylene (PE) or of a steel tube. The anchoring area of the sheath generally consists of a steel anchoring tube.

Strands of steel wires provided with a corrosion-proof coating of grease and a plastic sheath, generally of PE, are often used as the individual elements for braces of this type. This sheath may be extruded and thus fit tightly around the strand in the form of a tubular sheath, a so-called PE jacket, and move with it when the strand is tensioned, or it may surround the strand at a certain distance in the form of a tube. In this case, the strand is pulled out of the jacket during tensioning. While PE-sheathed strands of this type can be used in the same way as naked, unsheathed strands it is always necessary to expose the strands by removing the PE jacket in the area of the anchoring devices so that the ring wedges used for anchoring can engage directly with the metal surface of the strands.

The ends of the strands intended for anchoring are often exposed by removing the PE jacket prior to installation in the building structure in question. Here it is often difficult to determine exactly prior to installation the length along which the PE jacket must be removed in order to anchor the strands properly. If the exposed length proves to be too short, the reliability of the anchoring may be jeopardized. If on the other hand the exposed area is too long, the reliability of the anti-corrosion protection in this area may be jeopardized.

In order to remove a tightly fitting PE jacket from the strand irrespective of the tolerances involved in determining the required length and of structural inaccuracies in such a manner that in its final state, i.e. once the strand is tensioned, the remaining PE jacket ends as close as possible to the anchoring wedges, a method is already known whereby the PE jacket on each individual strand is removed along the length of the extension which occurs at the tensioned end during the tensioning processes (DE 197 33 822 A1). To this end, a jacket-removing tool is positioned in the area of the anchoring of the strand from which the tensioning process is to be carried out and used to remove the PE jacket during the tensioning process as a result of the longitudinal movement which occurs at the tensioning end when the strand is tensioned. It is generally sufficient to slit the PE jacket longitudinally so that it can then be separated from the remaining part of the jacket by means of an annular cut. This process is largely successful in avoiding errors due to structural tolerances and eliminating the need for costly measurements. However, the jacket-removing tool required to carry out this process is costly.

OBJECT OF THE INVENTION

Set against this background, the object of the invention is to find a simpler and less costly method of removing the PE jacket in the area of the tensioned end or of exposing the strand in this area in such a manner that, in its final state, the remaining PE jacket ends as close as possible to the area in which the strand is anchored.

REPRESENTATION OF THE INVENTION

As disclosed in the invention this object is achieved by means of the process described in claim 1.

Two independent anchoring devices suitable for carrying out this process for this type of strand are indicated in claims 7 and 8.

Advantageous developments are detailed in the subclaims.

Rather than removing the plastic jacket which fits tightly around the individual elements of a brace at the end at which said individual elements are tensioned and anchored along the entire length of the extension which occurs during tensioning, the basic idea behind the invention is to prevent said jacket from making the longitudinal movement in the anchoring area caused by the tensioning of the individual elements and thereby compressing it in the area prior to anchoring in so far as it follows the longitudinal movement of the strand during tensioning. During this compression the plastic jacket undergoes first elastic and then, at least in part, plastic deformation.

There are several possible methods of preventing the plastic jacket from moving longitudinally. A first possible method consists of inserting into the cylindrical part of the holes in the anchoring plate a compression tube which tightly surrounds an individual element and one end of which forms a stop for the end of the plastic jacket, while the opposite end lies adjacent to the thinner end of the anchoring wedge.

Another possible method consists in forming a shoulder in the area of the cylindrical part of the holes which penetrate the anchoring plate in the form of a blind hole extension against which the end of the plastic mantel then abuts. Since the diameter of the part of the cylindrical hole adjacent to the wedge then has to be the same as the external diameter of the individual element, this does however present the disadvantage that during assembly the individual elements cannot be inserted through the anchoring plate into the tubular sheath. Rather the anchoring plate has to be placed in position from outside after the individual elements have been introduced.

In many cases, a spacer made of plastic having holes through which the individual elements can pass is positioned behind the anchoring plate on the structure side. This permits a third possible method in which the shoulder forming the stop can be provided on this spacer which is in turn supported by the anchoring plate.

The extent of the possible compression of the plastic jacket is dependent upon the properties of the materials involved, the temperature and other factors. For this reason it may be useful, in particular in the case of long tensioning distances, to expose in advance a certain area of the end of the strand at which it is to be tensioned and anchored, either by removing the plastic jacket prior to installation or by removing the jacket during the tensioning process and simply using the compression process disclosed in the invention for fine tuning in order to extend the end of the plastic coat and thus the anti-corrosion protection as close as possible to the anchoring device.

DESCRIPTION OF THE DRAWING

The invention is described in greater detail below with reference to the drawing.

FIGS. 1 and 2 show an anchoring area of a bundle tensioning member (1), for example a stay cable on a cable-stayed bridge, comprising a number of individual tensioning elements (2). The individual elements (2) consist of strands (3) of steel wire which are provided with a tight fitting sheath of plastic, e.g. PE, or a so-called PE jacket, for protection against corrosion. The space between each strand (3) and the PE jacket (4) is filled with a mouldable anti-corrosion substance such as grease.

Figure 1:
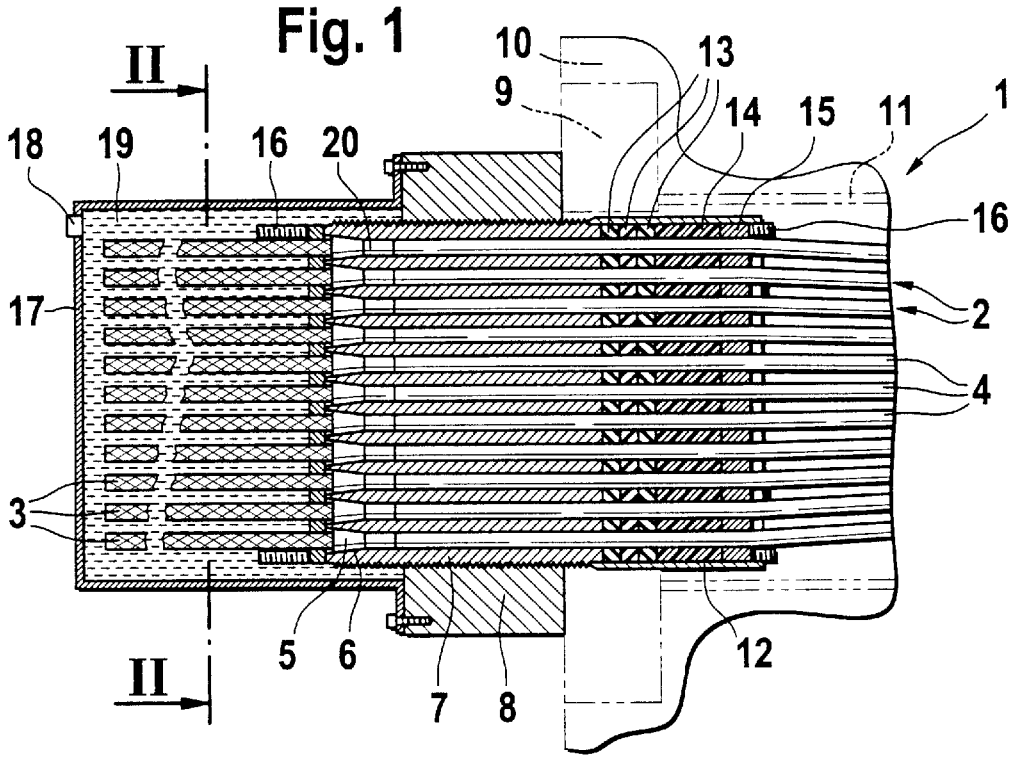
FIG. 1 shows a longitudinal section through an anchoring device in accordance with the invention.

The strands (3) are anchored in the conical parts of holes (6) in an anchoring plate (7) by means of multiple ring wedges (5). The anchoring plate (7) has an external thread and is surrounded by a ring nut (8) which has a corresponding internal thread and rests on an anchoring body (9) which lies on or is embedded in a building component, for example a concrete component (10). The tubular sheath which surrounds the bundle tensioning member (1) adjacent to the anchoring area is indicated by the reference numeral (11).

Fixed, for example welded, to the anchoring plate (7) on the side of the concrete component (10) is an anchoring tube (12). Within this anchoring tube adjacent to the anchoring plate is a gasket comprising one or more gasket sheets (13). Adjacent to the sheets (13) is a spacer (14) made of plastic, adjacent to which in turn is a pressure plate (15) made of steel. Both the gasket sheets (13) and the spacer (14) and pressure plate (15) have holes which are flush with the holes (6) in the anchoring plate (6) and through which the individual elements (2) pass. Threaded bolts (16) pass through the anchoring head thus formed which, when tightened, apply pressure from the air side on the gasket sheets (13) thus forcing them into a three-dimensionally tensioned state in which they provide a reliable seal against the individual elements (2) passing through them. On the air side, the entire anchoring head is closed in by a cover (17) through which anti-corrosion material (19) can be injected through an injection opening (18).

Figure 3:
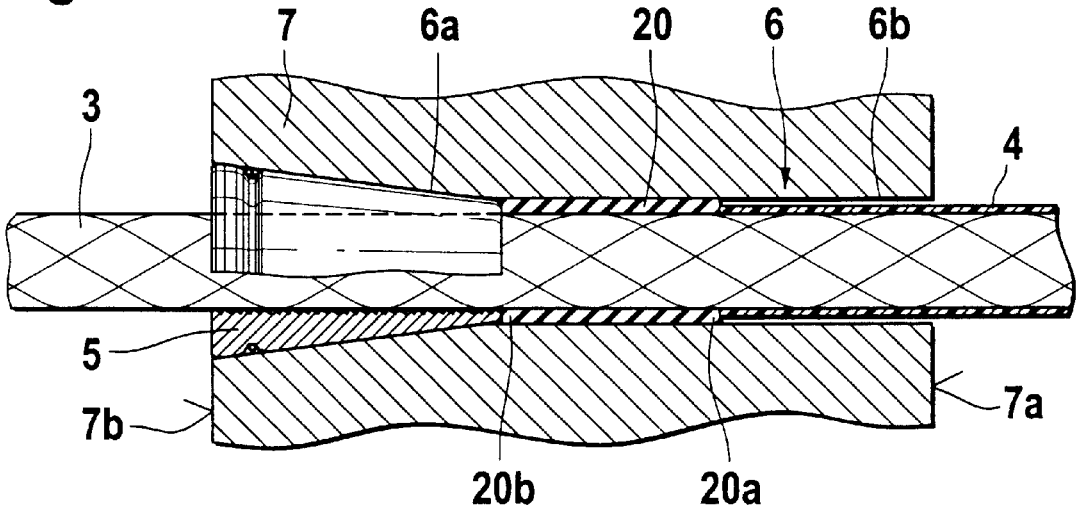
FIG. 3 shows a larger scale detail of the anchoring area of a strand in its anchored state.

In an enlarged detail of FIG. 1, FIG. 3 shows the anchoring area of an individual element (2) in a hole (6). It illustrates the hole (6) in the anchoring plate (7) which has a lower external surface (7*a*) and an upper external surface (7*b*) through which the individual element (2) passes and the ring wedge (5), partially in section and partially in plan view. For the sake of simplicity, the individual element (2) is illustrated as a steel wire. In practice, it is generally a strand (3) made up of steel wires for which reason this term is henceforth used. The hole (6) is divided into an upper conical are (6*a*) which receives the ring wedge (5) and a lower cylindrical area (6*b*).

A compression tube (20), its internal diameter being the same as the external diameter of the strand (3) and its external diameter the same as the internal diameter of the cylindrical part (6*b*) of the hole, is inserted into the lower cylindrical area (6*b*) of the hole. The lower end (20*a*) of the compression tube (20) forms a shoulder which acts as a stop for the end of the PE jacket (4). The upper end (20*b*) lies adjacent to the thin lower end (20*a*) of the ring wedge (5) which acts as a counter bearing. When the strand (3) is tensioned, leading to the extension and thus a longitudinal movement of the strand (3) and the PE jacket (4) which fits tightly around it, the end (20*a*) of the compression tube (20) acts as a stop for the PE jacket (4), preventing it from moving any further longitudinally if the strand (3) extends and consequently moves longitudinally through the anchoring plate (7) when tensioned.

Figure 4:
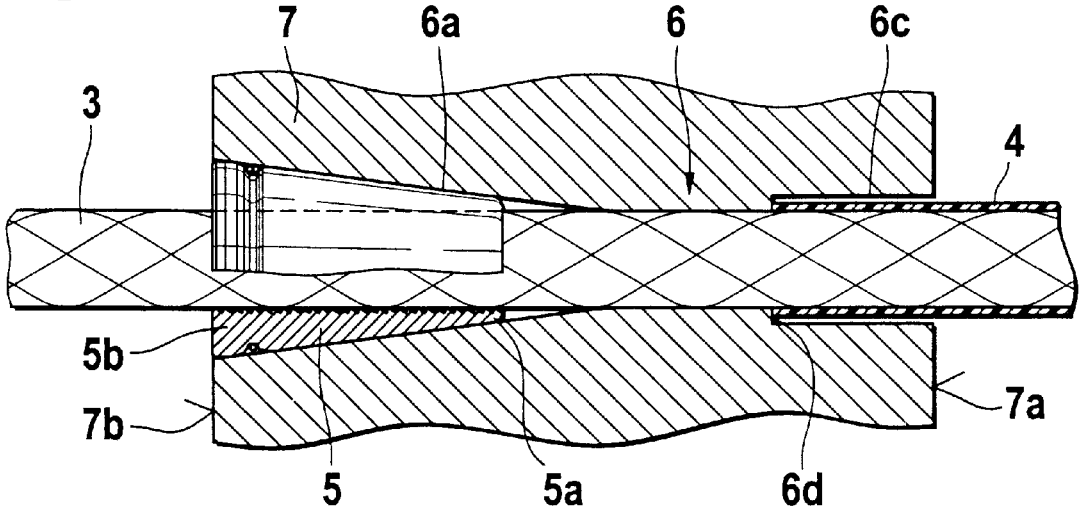
FIG. 4 shows a further embodiment in an appropriate representation.

FIG. 4 shows a second embodiment of a device of this type for preventing an axial movement of the PE Jacket (4). Here the lower cylindrical area (6*b*) of the hole (6) has an extension (6*c*) in the manner of a blind hole which forms an annular shoulder (6*d*) at the transition to the cylindrical area (6*b*). If the diameter of the cylindrical area (6*b*) is only just great enough to allow the strand (3) to pass through it, this shoulder (6*d*) acts as a stop for the PE jacket (4) which fits tightly around the strand (3) for the rest of its length and also prevents it from moving longitudinally if the strand (3) extends and consequently moves longitudinally through the anchoring plate (7) when tensioned.

Figure 2:
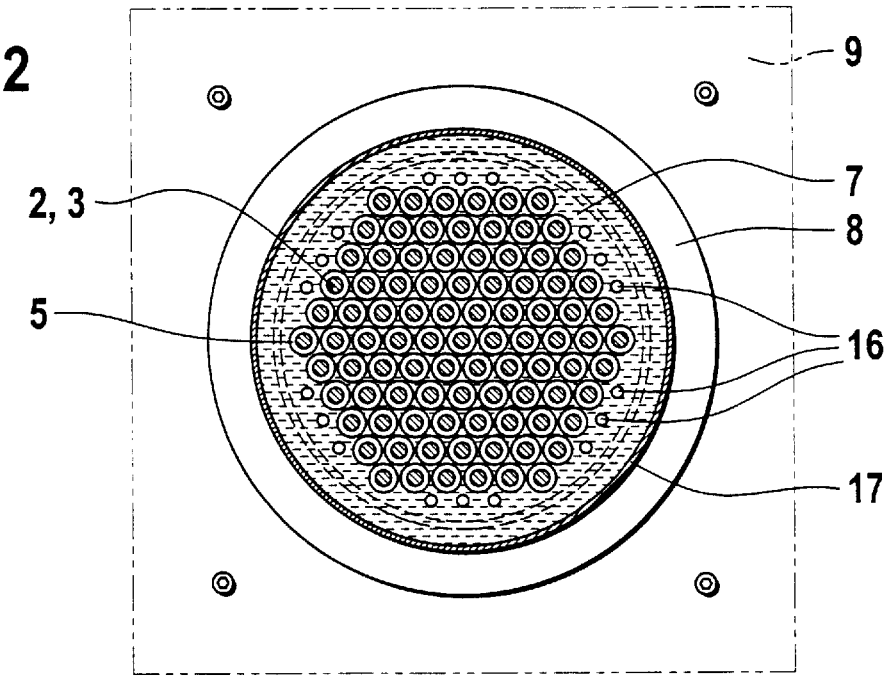
FIG. 2 shows a cross section along the line marked II—II in FIG. 1.
Figure 5:
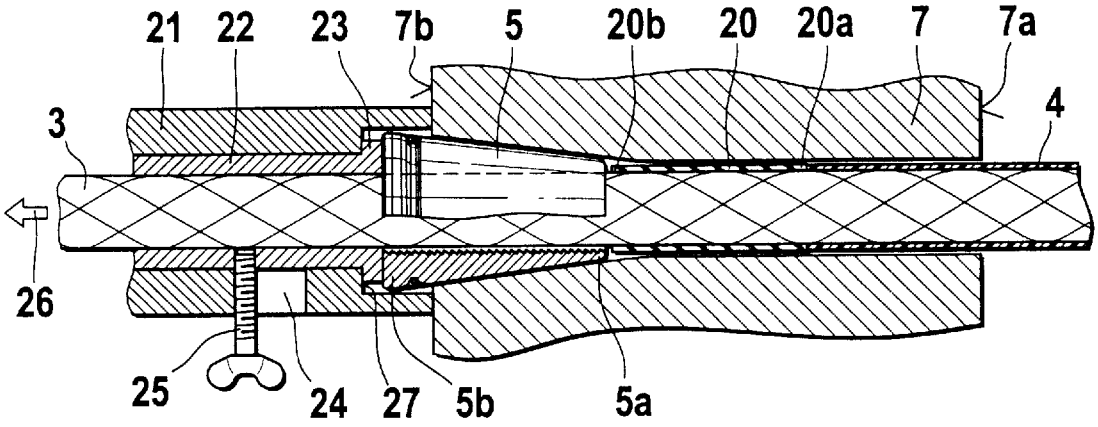
FIGS. 5 and 6 show the tensioning and anchoring process in appropriate representations.
Figure 6:
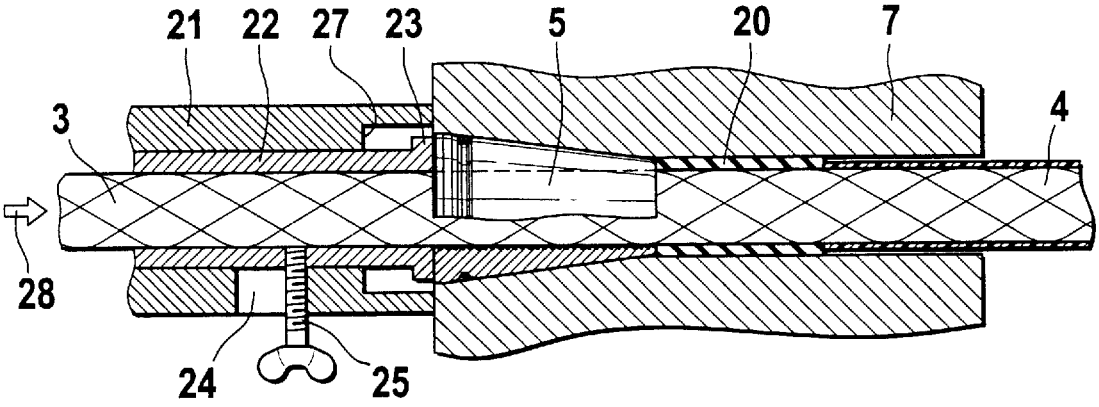

When the strand is being tensioned, in order to prevent the ring wedge (5) from opening so far that the compression tube (20) would be able to enter the wedge (5) in such a manner that the wedge would no longer be able to anchor the strand (3), it is necessary to limit the longitudinal movement of the wedge during tensioning. One way of doing this is shown in FIGS. 5 and 6 in representations similar to those in FIGS. 2 and 3. FIG. 5 shows the position during tensioning and FIG. 6 the tensioned and anchored position.

In FIG. 5 a plunger (22) with a lower flange (23) which rests on the air-side thicker end (5*b*) of the wedge (5) is positioned inside the head attachment (21) of a tensioning press (not illustrated) which is supported on the top (7*b*) of the anchoring plate (7). In the side wall of the head attachment (21) is a recess (24) in which a locking screw (25) is located in such a manner that it can move and which can be screwed into a transverse hole in the plunger (22). In this case, when the strand (3) is tensioned the longitudinal movement of the ring wedge (5) is limited in the direction of the arrow (26) due to the fact that the flange (23) of the plunger (22) acts as a stop for the air-side thicker end (5*b*) of the ring wedge (5), the flange itself lying adjacent to a shoulder (27) inside the head attachment (21). This prevents the wedge (5) from widening too far.

On the other hand, at the end of the tensioning process it is important to ensure that, despite the spring action of the compressed PE jacket (4), the ring wedge (5) which develops restoring forces is drawn into the conical area (6*a*) of the hole (6) in order to guarantee that it is properly anchored. This can be achieved either in the known manner by pushing the wedge (5) by means of a wedging piston positioned on the tensioning press into the conical area (6*a*) of the hole (6) while the strand (3) is held in position or, as illustrated in FIG. 6, by fixing the plunger (22) against the strand (3) by means of the clamping screw (25) so that, once the connection to the tensioning press is released as a result of the tensioning force transmitted to it, the strand (3) carries the wedge (5) with it in the direction of the arrow (28) into its seat in the conical area (6*a*) of the hole (6). Once the strand (3) has been anchored in this manner the press and plunger (22) can be removed.

What is claimed is:

1. A process for installing and tensioning a brace having a free bearing, the brace having a bundle of individual elements made of steel and surrounded by plastic jackets wherein ends of the individual elements are anchored by wedges in an anchoring plate supported by a building structure, the process comprising tensioning the individual elements in a longitudinal direction, preventing the plastic jacket of each individual element from moving in the longitudinal direction by a stop formed by an annular shoulder surrounding the element in an anchoring area, and thereby axially compressing the plastic jacket and exposing a portion of the individual element.

2. The process according to claim 1, comprising bringing the wedge into an anchoring position in the anchoring plate after tensioning of the individual members against a restoring force of the compressed plastic jacket.

3. The process according to claim 2, comprising pressing the wedge into a seat in a hole in the anchoring plate by applying an external longitudinal force while holding the tensioned individual element in position.

4. The process according to claim 2, comprising overtensioning each individual element by a certain amount, fixing the wedge to the overtensioned individual element, and, when reducing the tensioning force to a predetermined value, drawing the wedge by means of the individual element into a seat in a hole of the anchoring plate.

5. The process according to claim 4, comprising in limiting the longitudinal movement of the wedge resulting from tensioning the individual elements by means of a stop.

6. The process according to claim 1, comprising exposing each individual element in successive stages, wherein a first stage comprises removing the plastic jacket, and wherein a second stage comprises holding back and axially compressing the plastic jacket.

7. An anchoring device for installing and tensioning a brace having a free bearing, the brace having a bundle of individual elements made of steel and surrounded by plastic jackets, the device comprising an anchoring plate adapted to be supported against a building structure, the anchoring plate having a plurality of holes through which the individual elements extend for anchoring the individual elements by means of wedges, and an annular shoulder extending around each individual element in an anchoring area for preventing movement of the plastic jacket and for axially compressing the plastic jacket when the individual element is tensioned.

8. The anchoring device according to claim 7, further comprising a compression tube surrounding each individual element in the area of the hole of the anchoring plate, wherein a first end of the compression tube forms the shoulder and a second end of the compression tube is in contact with the anchoring wedge.

9. The anchoring device according to claim 8, wherein an internal diameter of the compression tube is equal to an external diameter of the individual element, and wherein an external diameter of the compression tube is equal to an internal diameter of the hole of the anchoring plate.

10. The anchoring device according to claim 7, wherein the shoulder is formed at a bottom of an increased diameter portion of each hole of the anchoring plate.

11. The anchoring device according to claim 7, wherein the shoulder os formed on a spacer positioned behind the anchoring plate on a side of the building structure, wherein the spacer has holes through which the individual elements extend.

* * * * *